US010401135B2

(12) United States Patent
Bootes et al.

(10) Patent No.: US 10,401,135 B2
(45) Date of Patent: Sep. 3, 2019

(54) PENETRATOR MUNITION WITH ENHANCED FRAGMENTATION

(71) Applicant: Raytheon Company, Waltham, MA (US)

(72) Inventors: Thomas H. Bootes, Tucson, AZ (US); George D. Budy, Tucson, AZ (US); Wayne Y. Lee, Santaquin, UT (US); Richard K. Polly, Tucson, AZ (US); Jason M. Shire, Tucson, AZ (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/117,864

(22) PCT Filed: Feb. 11, 2015

(86) PCT No.: PCT/US2015/015422

§ 371 (c)(1),
(2) Date: Aug. 10, 2016

(87) PCT Pub. No.: WO2015/175038

PCT Pub. Date: Nov. 19, 2015

(65) Prior Publication Data

US 2016/0370159 A1 Dec. 22, 2016

Related U.S. Application Data

(60) Provisional application No. 61/986,985, filed on May 1, 2014, provisional application No. 61/938,297, filed on Feb. 11, 2014.

(51) Int. Cl.
*F42B 12/22* (2006.01)
*F42B 12/24* (2006.01)
(Continued)

(52) U.S. Cl.
CPC ..... *F42B 12/204* (2013.01); *F42B 12/04* (2013.01); *F42B 12/22* (2013.01); *F42B 12/24* (2013.01);
(Continued)

(58) Field of Classification Search
CPC ..... F42B 12/02; F42B 12/04; F42B 12/06; F42B 12/08; F42B 12/20; F42B 12/201;
(Continued)

(56) References Cited

U.S. PATENT DOCUMENTS 1,006,875 A 10/1911 Puff
1,300,333 A 4/1919 Berry
(Continued)

FOREIGN PATENT DOCUMENTS

CH 649627 A5 5/1985
DE 2557676 A1 6/1977
(Continued)

OTHER PUBLICATIONS

International Search Report for corresponding International Application No. PCT/US2015/015422 dated Nov. 24, 2015.
(Continued)

*Primary Examiner* — James S Bergin
(74) *Attorney, Agent, or Firm* — Renner, Otto, Boisselle & Sklar, LLP

(57) ABSTRACT

A munition, such as a warhead, includes a penetrator casing for penetrating hard targets, such as a fortification or reinforced building or other structure, with the penetrator casing having reduced-thickness portions. The reduced-thickness portions provide weak points to the casing that facilitate the casing being transformed into fragments of a desired size/quantity when an explosive within the casing is detonated after the penetration occurs, thus enhancing the effectiveness of the munition. In addition, the warhead may have lethality-
(Continued)

enhancing materials, such as additional fragments and/or energetic materials, at the reduced-thickness portions of the penetrator casing. The reduced-thickness portions may be holes, such as longitudinal holes, in the casing, or may be grooves on an inner and/or outer surface of the casing. The munition may be a dual-use munition, with the explosive able to be detonated at a burst height for use of the warhead as a non-penetrating area fragmentation weapon.

17 Claims, 12 Drawing Sheets

(51) Int. Cl.

| | |
|---|---|
| ***F42B 12/32*** | (2006.01) |
| ***F42B 25/00*** | (2006.01) |
| ***F42C 19/02*** | (2006.01) |
| ***F42B 12/20*** | (2006.01) |
| ***F42B 12/04*** | (2006.01) |

(52) U.S. Cl.
CPC ..... *F42B 12/32* (2013.01); *F42B 25/00* (2013.01); *F42C 19/02* (2013.01)

(58) Field of Classification Search
CPC ..... F42B 12/202; F42B 12/204; F42B 12/22; F42B 12/24; F42B 12/32; F42B 25/00; F42C 19/02
USPC ..... 102/382, 389, 493, 517, 518, 519
See application file for complete search history.

(56) References Cited

U.S. PATENT DOCUMENTS

| | | | | |
|---|---|---|---|---|
| 2,337,765 | A | 12/1942 | Nahirney | |
| 2,972,950 | A | 2/1961 | Welanetz | |
| 3,134,330 | A | 5/1964 | Batou | |
| 3,474,731 | A | 10/1969 | Thomanek | |
| 3,744,419 | A | 7/1973 | Hand | |
| 3,815,504 | A * | 6/1974 | Tieben | F42B 12/32 102/496 |
| 3,820,464 | A | 6/1974 | Dixon | |
| 3,981,243 | A | 9/1976 | Doris, Jr. | |
| 4,063,512 | A | 12/1977 | Davis | |
| 4,327,643 | A | 5/1982 | Lasheras Barrios | |
| 4,353,305 | A | 10/1982 | Moreau et al. | |
| 4,524,696 | A | 6/1985 | Altenau et al. | |
| 4,592,283 | A | 6/1986 | Hellner et al. | |
| 4,648,323 | A | 3/1987 | Lawther | |
| 4,664,035 | A | 5/1987 | Osofsky | |
| 4,693,317 | A | 9/1987 | Edwards et al. | |
| 4,882,996 | A | 11/1989 | Bock et al. | |
| 4,896,607 | A | 1/1990 | Hall et al. | |
| 5,078,051 | A | 1/1992 | Amundson | |
| H001048 | H | 5/1992 | Wilson et al. | |
| 5,117,759 | A | 6/1992 | Henderson et al. | |
| 5,131,329 | A | 7/1992 | Lips et al. | |
| 5,305,505 | A | 5/1994 | Ruhlman | |
| 5,313,890 | A | 5/1994 | Cuadros | |
| 5,535,679 | A | 7/1996 | Craddock | |
| 5,656,792 | A | 8/1997 | Rentzsch et al. | |
| 5,698,814 | A | 12/1997 | Parsons et al. | |
| 5,717,397 | A | 2/1998 | Ruszkowski, Jr. | |
| 5,852,256 | A | 12/1998 | Hornig | |
| 5,939,662 | A | 8/1999 | Bootes et al. | |
| 6,105,505 | A | 8/2000 | Jones | |
| 6,135,028 | A | 10/2000 | Kuhns et al. | |
| 6,186,072 | B1 | 2/2001 | Hickerson, Jr. et al. | |
| 6,374,744 | B1 | 4/2002 | Schmacker et al. | |
| 6,389,977 | B1 | 5/2002 | Schmacker et al. | |
| 6,484,642 | B1 | 11/2002 | Kuhns et al. | |
| 6,523,477 | B1 * | 2/2003 | Brooks | F42B 30/003 102/481 |
| 6,601,517 | B1 | 8/2003 | Guirguis | |
| 6,619,210 | B1 | 9/2003 | Spivak et al. | |
| 6,659,013 | B1 | 12/2003 | Kellner | |
| 6,966,265 | B2 * | 11/2005 | Ronn | F42B 12/32 102/389 |
| 7,152,532 | B2 * | 12/2006 | Conrad | F42B 12/06 102/473 |
| 7,231,876 | B2 * | 6/2007 | Kellner | F42B 12/204 102/491 |
| 7,614,348 | B2 | 11/2009 | Truitt et al. | |
| 7,971,533 | B1 | 7/2011 | Berlin et al. | |
| 8,061,275 | B1 | 11/2011 | Gold | |
| 8,161,884 | B1 | 4/2012 | Kokodis et al. | |
| 8,176,849 | B1 | 5/2012 | Gold et al. | |
| 8,191,479 | B2 | 6/2012 | Ruhlman et al. | |
| 8,234,979 | B1 | 8/2012 | Falabella et al. | |
| 8,387,539 | B1 | 3/2013 | Maines | |
| 8,671,840 | B2 | 3/2014 | Scheid et al. | |
| 8,701,557 | B2 | 4/2014 | Biggs et al. | |
| 9,291,437 | B2 | 3/2016 | Bonnstetter et al. | |
| 9,423,226 | B2 | 8/2016 | Cillaut et al. | |
| 9,683,822 | B2 | 6/2017 | Kerns et al. | |
| 9,816,793 | B2 | 11/2017 | Budy et al. | |
| 10,018,453 | B1 * | 7/2018 | McCoy | F42B 12/24 |
| 2003/0019386 | A1 * | 1/2003 | Lloyd | F41H 11/02 102/494 |
| 2003/0167956 | A1 | 9/2003 | Kellner | |
| 2003/0172833 | A1 | 9/2003 | Ronn et al. | |
| 2005/0115450 | A1 | 6/2005 | Lloyd | |
| 2005/0223930 | A1 | 10/2005 | Bootes et al. | |
| 2005/0235862 | A1 | 10/2005 | Gousman et al. | |
| 2010/0032515 | A1 | 2/2010 | Geswender et al. | |
| 2010/0199875 | A1 * | 8/2010 | Weihrauch | F42B 12/204 102/492 |
| 2011/0162548 | A1 | 7/2011 | Berlin et al. | |
| 2012/0017795 | A1 | 1/2012 | Dryer et al. | |
| 2012/0227609 | A1 | 9/2012 | Volkmann | |
| 2012/0291651 | A1 | 11/2012 | Haumann et al. | |
| 2014/0299012 | A1 | 10/2014 | Odintsov | |
| 2016/0025467 | A1 | 1/2016 | Botthof et al. | |
| 2016/0377396 | A1 * | 12/2016 | Bootes | F42B 12/204 102/493 |
| 2018/0156586 | A1 | 6/2018 | Bootes et al. | |

FOREIGN PATENT DOCUMENTS

| | | | |
|---|---|---|---|
| EP | 1001244 | A1 | 5/2000 |
| EP | 1316774 | A1 | 6/2003 |
| EP | 1367358 | A2 | 12/2003 |
| EP | 1864960 | A2 | 4/2007 |
| EP | 2095059 | B1 | 6/2010 |
| FR | 2910612 | A1 | 6/2008 |
| GB | 2384291 | A | 11/1993 |
| JP | 2008-261627 | A | 10/2006 |
| WO | 98/30863 | A1 | 7/1998 |
| WO | 9830863 | A1 | 7/1998 |
| WO | 0203008 | A1 | 1/2002 |
| WO | 2008089078 | A2 | 7/2008 |
| WO | 2008096069 | A1 | 8/2008 |
| WO | 2009102254 | A1 | 8/2009 |
| WO | 2011054361 | A1 | 5/2011 |
| WO | 2011054361 | A1 | 12/2011 |
| WO | 2015175036 | A2 | 11/2015 |
| WO | 2015175037 | A2 | 11/2015 |
| WO | 2015175038 | A2 | 11/2015 |
| WO | 2015175039 | A2 | 11/2015 |
| WO | 2015175040 | A2 | 11/2015 |
| WO | 2016022181 | A1 | 2/2016 |
| WO | 2016022199 | A1 | 2/2016 |

OTHER PUBLICATIONS

Written Opinion for corresponding International Application No. PCT/US2015/015422 dated Nov. 24, 2015.

(56) References Cited

OTHER PUBLICATIONS

Office Action issued in corresponding Korean Application No. 10-2016-7024770 dated Feb. 12, 2018, and the English translation.

* cited by examiner

PENETRATOR MUNITION WITH ENHANCED FRAGMENTATION

This application claims priority to U.S. Provisional Application 61/938,297, filed Feb. 11, 2014, and to U.S. Provisional Application 61/986,985, filed May 1, 2014. Both of these applications are incorporated by reference in their entireties.

FIELD OF THE INVENTION

The present invention generally relates to munitions useable for attacking hard targets, such as buildings or fortifications.

DESCRIPTION OF THE RELATED ART

Weapons for penetrating hard targets, such as buildings or fortifications having reinforced concrete walls, have generally used steel casings to survive challenging impact conditions against hardened target structures. Using solid steel cased cylindrical wall structures that protect the explosive payload during penetration have been the standard. However, this approach results in relatively low numbers of large naturally formed steel cased fragments upon warhead detonation inside the hardened target.

SUMMARY OF THE INVENTION

A warhead for a munition, such as a missile or bomb, has a penetration casing with reduced-thickness portions that selectively weaken parts of the casing. This allows enhanced formation of fragments from the casing when an explosive enclosed by the casing is detonated, such as after the warhead has penetrated a hardened target. The reduced-thickness portions may be non-intersecting portions where the casing has holes therein, or grooves on an outer and/or inner surface of the casing. A lethality-enhancement material, for example including preformed fragments or an energetic material, may be placed at the reduced-thickness portions (e.g., in the holes or the grooves) to further enhance effectiveness.

According to an aspect of the invention, a warhead includes: a penetrator casing; and an explosive within the penetrator casing. The casing has a series of non-intersecting elongate reduced-thickness portions, thinner than portions of the casing that are adjacent the reduced-thickness portions.

In some embodiments the penetrator casing has a nose, and an aft section extending back from the nose; the reduced-thickness portions are parts of the aft section; and the nose has a thickest portion that is at least twice the thickness of the portions of the casing that are adjacent the reduced-thickness portions.

In some embodiments the aft section is substantially cylindrical.

In some embodiments the elongate reduced-thickness portions are parallel to one another.

In some embodiments the elongate reduced-thickness portions extend in straight lines.

In some embodiments the elongate reduced-thickness portions extend substantially parallel to a longitudinal axis of the warhead.

In some embodiments the elongate reduced-thickness portions are portions in which the casing has holes therein.

In some embodiments the holes include a series of longitudinal holes therein, separated circumferentially around the penetrator casing.

In some embodiments the elongate reduced-thickness portions are portions in which the casing has grooves therein. The grooves may be on an inside surface of the casing. Alternatively or in addition the grooves may be on an outside surface of the casing.

In some embodiments the warhead includes a lethality-enhancement material located at the reduced-thickness portions of the penetrator casing. The lethality-enhancement material may include solid fragments that are projected by the warhead when the explosive is detonated. The lethality-enhancement material may include an energetic material that releases energy when the explosive is detonated.

In some embodiments the solid fragments include spherical fragments.

In some embodiments the solid fragments include fragments in casings.

In some embodiments the solid fragments include fragments having flat bodies.

In some embodiments fragments having flat bodies are star-shape fragment having a series of protrusions extending from each of the flat bodies.

In some embodiments the protrusions are edged protrusions.

In some embodiments the solid fragments are part of a repeating pattern of different fragments.

According to another aspect of the invention, a warhead includes: a penetrator casing; and an explosive within the penetrator casing. The penetrator casing has a nose, and an aft section extending back from the nose; the aft section is substantially cylindrical; and the aft section has a series of longitudinal holes therein, separated circumferentially around the penetrator casing.

In some embodiments the warhead includes a lethality enhancement material located at the reduced-thickness portions of the penetrator casing. The lethality-enhancement material includes one or both of solid fragments that are projected by the warhead when the explosive is detonated, and an energetic material that releases energy when the explosive is detonated.

In some embodiments the lethality-enhancement material includes solid fragments that have multiple different materials, and/or multiple different sizes.

According to yet another aspect of the invention, a method of engaging a hard target includes the steps of: penetrating the hard target with a penetrator casing of a warhead; and after the penetrating, detonating an explosive that is within the penetrator casing. Detonating the explosive produces fragments from a series of non-intersecting elongate reduced-thickness portions of the casing, that are thinner than portions of the casing that are adjacent the reduced-thickness portions.

In some embodiments the warhead includes additional solid fragments located at the reduced-thickness portions of the penetrator casing. The detonating may include projecting the additional solid fragments.

In some embodiments the elongate reduced-thickness portions are portions in which the casing has holes therein. The additional solid fragments may be located in the holes, prior to the detonating.

In some embodiments the warhead includes energetic material located at the reduced-thickness portions of the penetrator casing. The detonating includes reacting the energetic material to produce additional energy for projecting the fragments.

According to an aspect of the invention, a munition includes: a penetrator casing; and a fuzewell within the penetrator casing; wherein the fuzewell includes one or more shock-absorbing features for absorbing shocks.

According to another aspect of the invention, a munition includes: a penetrator casing; and a fuzewell within the penetrator casing; wherein the fuzewell includes one or more deformable structures that preferentially deform relative to a central housing of the fuzewell.

In some embodiments the one or more shock-absorbing features facilitate absorption of shocks in a radial, circumferential, and/or axial direction.

In some embodiments the fuzewell includes a central housing, and a ring surrounding the central housing.

In some embodiments the one or more shock-absorbing features include spokes that connect the ring to the central housing.

In some embodiments the spokes have curvature and/or variations in thickness that facilitate flexing of the spokes in response to forces on the munition, such as forces in the radial, circumferential, and/or axial direction.

In some embodiments the spokes have curvature in a circumferential direction.

In some embodiments the spokes define openings between the spokes, with the openings operable to vent gases from an explosive that is within the casing.

In some embodiments the central housing has a non-uniform thickness.

In some embodiments the ring is connected to a relatively thick portion of the central housing.

In some embodiments the munition includes a fuze within the central housing, the fuze operably coupled to an explosive within the penetrator casing to detonate the explosive.

In some embodiments the central housing has an opening for receiving an electrical line for coupling to the fuze.

In some embodiments the fuzewell has an axisymmetric configuration.

According to yet another aspect of the invention, a munition includes: a penetrator casing; an explosive within the casing; and a fuzewell within the penetrator casing; wherein the fuzewell includes one or more openings that allow venting from the explosive.

In some embodiments the fuzewell includes a central housing, and a ring around the central housing; and the openings are between the central housing and the ring.

In some embodiments the fuzewell includes spokes connecting the ring to the central housing; and the spokes define the openings therebetween.

According to a further aspect of the invention, a munition comprising; a penetrator casing; an explosive within the casing; a fuze for detonating the explosive; and a cable coupled to a fuze for providing a detonation signal to the fuze; wherein the penetrator casing has a nose, and an aft section extending back from the nose; wherein the nose has a thickest portion that is at least twice the thickness of the aft section; and wherein the cable interfaces with an interface in the aft section of the penetrator casing.

In some embodiments the cable is connected to a coupling at the opening in the aft section.

In some embodiments the munition includes an external electrical harness that electrically couples to the cable; the external electrical harness runs outside of the penetrator casing, forward of the interface.

In some embodiments the munition includes an enclosure around an outside of the penetrator casing.

In some embodiments the enclosure is a clamshell enclosure.

In some embodiments the munition includes a nose kit forward of the penetrator casing.

In some embodiments the electrical harness is coupled to the nose kit.

In some embodiments the nose kit is coupled to a forward connection of an enclosure around an outside of the penetrator casing.

In some embodiments the munition includes a tail kit aft of the penetrator casing.

In some embodiments the tail kit is coupled to an aft connection of an enclosure around an outside of the penetrator casing.

According to a still further aspect of the invention, a munition includes: a penetrator warhead and an enclosure around the outside of the penetrator casing, enclosing the penetrator warhead. The penetrator warhead includes: a penetrator casing; and an explosive within the penetrator casing.

In some embodiments the enclosure is a clamshell enclosure.

According to another aspect of the invention, a munition includes a warhead that includes: a casing; and an explosive within the casing. The warhead also includes an enclosure around the outside of the casing, enclosing the warhead. The enclosure includes solid fragments that are propelled outward when the explosive is detonated.

In some embodiments the solid fragments are in openings or pockets within the enclosure.

In some embodiments the solid fragments are enclosed as parts of self-contained fragmentation packs that are located in the openings or pockets.

In some embodiments the fragmentation packs are flexible.

In some embodiments the fragmentation packs include a fragmentation pack casing that contains the fragments.

In some embodiments the fragmentation pack casing is a sealed fragmentation pack casing.

In some embodiments the fragmentation pack casing is a metal and/or plastic fragmentation pack casing.

In some embodiments a metallic powder material is within the enclosure.

In some embodiments the metallic powder material includes aluminum, magnesium, zirconium or titanium.

In some embodiments the metallic powder material is an incendiary material.

In some embodiments the metallic powder material is within a flexible bag or casing.

According to yet another aspect of the invention, a munition includes an airframe, and a warhead or munition within the airframe. The airframe has openings therein, and there are fragments in the openings.

According to a further aspect of the invention, a warhead includes: a penetrator casing; an explosive within the penetrator casing; and a lethality enhancement material that includes solid fragments. The penetrator casing has a nose, and an aft section extending back from the nose. The nose is a monolithic nose with no holes or cutouts therethrough. The aft section is substantially cylindrical. The aft section has a series of longitudinal holes therein, separated circumferentially around the penetrator casing. The lethality enhancement material is located in the longitudinal holes in the penetrator casing.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition, such as a warhead, includes a penetrator casing for penetrating hard targets, such as a fortification or reinforced building or other structure, with the penetrator casing having reduced-thickness portions. The reduced-thickness portions provide weakness points to the casing that facilitate the casing being transformed into fragments of a semi-controlled and desirable size when an explosive within the casing is detonated after the penetration occurs, thus enhancing the effectiveness of the munition. In addition, the warhead may have lethality-enhancing materials, such as additional fragments and/or energetic material(s), at the reduced-thickness portions of the penetrator casing. The reduced-thickness portions may be holes, such as longitudinal holes, in the casing, or may be grooves on an inner and/or outer surface of the casing. The munition may be a dual-use munition that may also function as a dual mode weapon, with the explosive able to be detonated at a burst height for use of the warhead as a non-penetrating fragmentation weapon.

Figure 1:
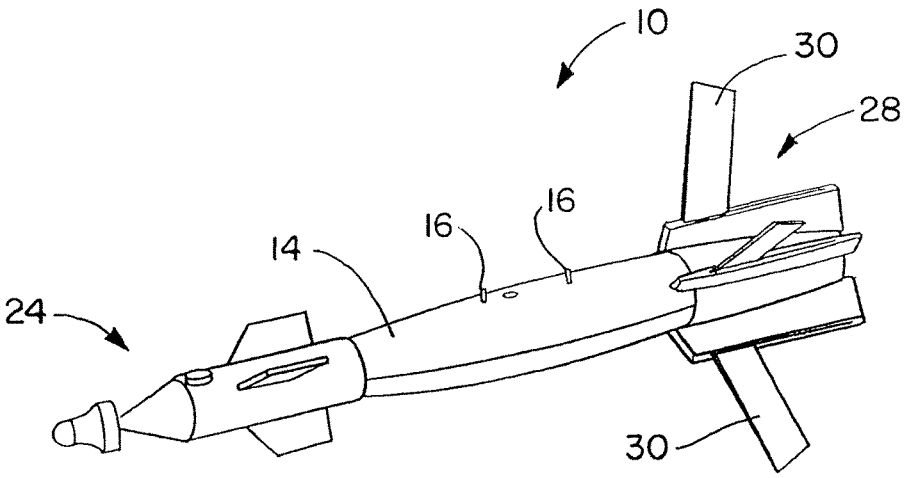
FIG. 1 is an oblique view of a munition in accordance with the present invention.
Figure 2A:
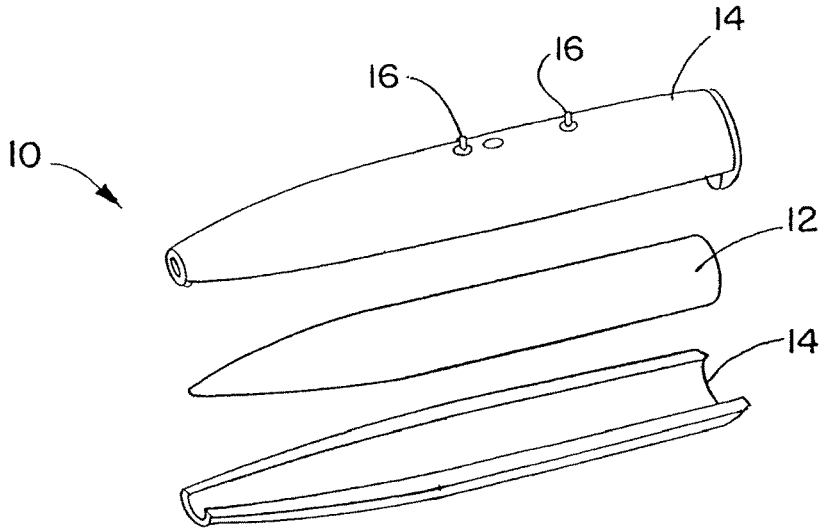
FIG. 2A is an exploded view showing parts of the munition of FIG. 1.
Figure 2B:
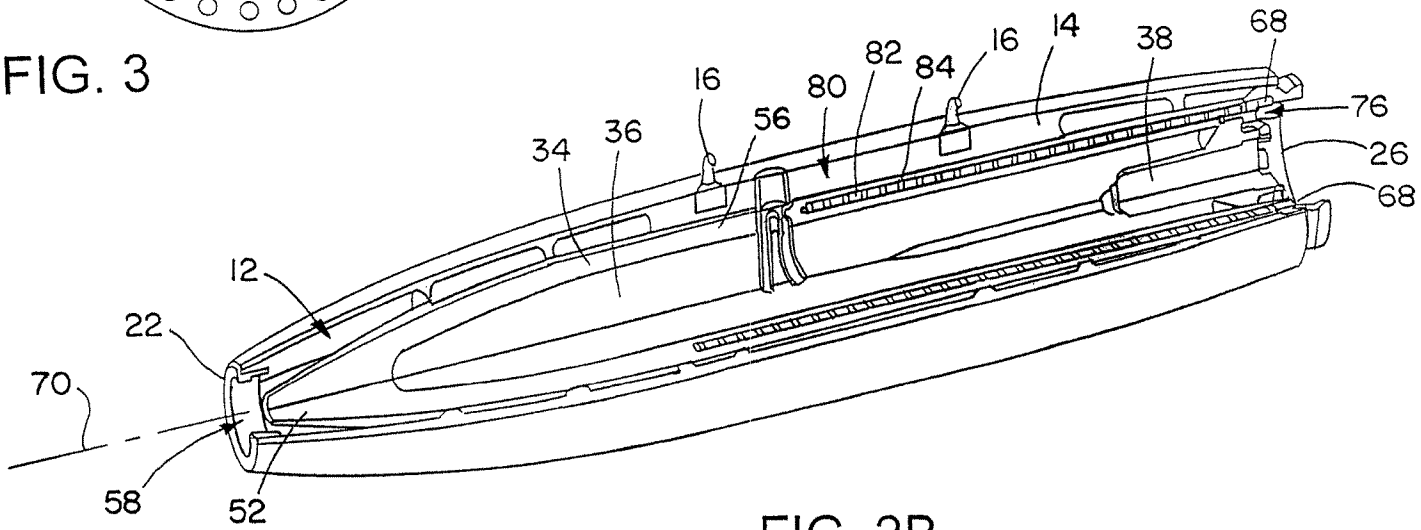
FIG. 2B is an oblique partial cutaway view showing details of a warhead of the munition of FIG. 1.

Referring initially to FIGS. 1, 2A, and 2B, a munition 10, such as a missile or guided bomb, has a warhead 12 that is contained within an airframe 14 that has connection lugs 16 for connection to an aircraft or other platform for launching the munition 10. The airframe 14 has a forward connection 22 for receiving a guidance nose kit 24 (for example), and an aft connection 26 for receiving (for example), a tail kit 28 with deployable fins 30. The airframe 14 may be configured for using a standard weapons mount on a launch platform that is also able to receive other types of weapons. The connections 22 and 26 may be standard connections that are similar to those used for other munitions, thus enabling use of standard nose and tail kits that may be used with other sorts of munitions. The airframe 14 may be in the form of a pair of clamshell halves that fit around the warhead 12, and may be made of a relatively lightweight material, such as aluminum.

The warhead 12 has a penetrator casing 34 that encloses an explosive 36. The explosive 36 is detonated by a fuze 38 that is at an aft end of the explosive 36. The casing 34 has a forward nose 52, and an aft section 56 extending back from the nose 52. In the illustrated embodiment, the forward nose 52 of the penetrator case 34 is solid in nature, a monolithic structure with no cutout or through holes to accommodate forward mounted fuzing such as that used in general purpose bomb cases. The forward nose 52 is thickest at an apex 58 of the nose 52, and has a thickness that reduces the farther back you go along the casing 34, tapering gradually to the thickness of the substantially cylindrical aft section 56. The nose 52 may have a maximum thickness that is at least twice the thickness of the thickest part of the casing 34 in the cylindrical aft section 56.

Figure 3:
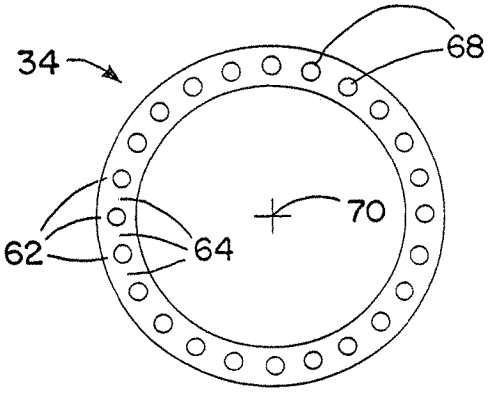
FIG. 3 is an end view showing details of a casing of the warhead of FIGS. 2A and 2B.

With reference in addition to FIG. 3, the aft section 56 has a series of reduced-thickness portions 62 that are adjacent to other portions 64 of the aft section 56 that do not have a reduced thickness. The reduced-thickness portions 62 introduce weakness into parts of the penetrator casing 34, facilitating break-up of the casing 34 when the explosive 36 is detonated. This may enhance the production of fragments from all or part of the casing 34 when the explosive 36 is detonated, enhancing the lethality of the warhead 12.

In the illustrated embodiment the reduced-thickness portions 62 are a series of holes 68 that are parallel to a longitudinal axis 70 of the warhead 12. The holes 68 do not intersect with one another, and are distributed circumferentially about the aft section 56. The holes 68 may be substantially evenly distributed in the circumferential direction around the aft section 56, although a non-even distribution is a possible alternative. The use of the holes 68 to produce the reduced-thickness portions 62 is just one possible configuration. Alternatives, such as notches or grooves on the inner and/or outer surfaces of the aft section 56, may also be used. These alternatives are discussed further below.

The reduced-thickness portions 62 in the illustrated embodiment are non-intersecting, and are elongate, having lengths (in the axial or longitudinal direction) that are for example of at least ten times their widths (in the circumferential direction). The reduced-thickness portions 62 may be substantially identical in their lengths, widths, and reduction in thickness of material, although alternatively the reduced-thickness portions 62 may vary from one to another with regard to one or more of these parameters.

The aft section 56 may have a thickness of 1.9 to 5.1 cm (0.75 to 2 inches). The holes 68 may have a diameter of about 1.27 cm (0.5 inches), or more broadly from 0.31 to 1.9 cm (0.125 to 0.75 inches). These values are only examples, and a wide variety of other values are possible.

The volume of material removed for the reduced-thickness portions 62 (the volume reduction relative to a casing in which the reduced-thickness portions 62 had the same thickness as the adjacent portions 64) may be 1 percent to 85 percent of the volume of the casing 34 or the volume of the aft section 56.

The holes 68 may be filled with a lethality-enhancement material 76, to further increase the effectiveness of the warhead 12. In the illustrated embodiment, the holes 68 are filled with preformed fragments 80. The fragments 80 include two types of fragments, with steel preformed fragments 82 alternating with zirconium-tungsten preformed fragments 84, and with the fragments 82 having a different size and shape from the fragments 84. More broadly, the fragments 80 may include fragments with different materials, different shapes, and/or different sizes, although as an alternative all of the fragments may be substantially identical in material, size, and shape. Other materials, such as spacers, may be placed between the hard preformed fragments.

The fragments 80 may each be 0.3 to 450 grams (5 to 7000 grain weights), for example. The fragments 80 may be spheres, cubes, cylinders, flechetts, parallelepipeds, uncontrolled solidification shapes (such as used in HEVI-SHOT shotgun pellets), to give a few non-limiting examples. The material for the fragments 80 may be one or more of steel, tungsten, aluminum, tantalum, lead, titanium, zirconium, copper, molybdenum, etc. There may be a wide range of the number of the fragments 80 in the munition 10, with as few as 10 fragments for a small warhead, to as many as 1,000,000 for very large munitions.

One advantage of the munition 10 is that it provides flexibility and adaptability for fragment sizes, weights, and shapes. These parameters are tailorable in accordance with mission requirements. Smaller fragments, for example the size of pebbles, are more suitable for localized full coverage, while larger fragment sizes allow more observable damages within the target site.

The fragments 80 are projected outward from the warhead 12 when the explosive 36 is detonated. Thus the warhead 12 has the characteristics of both a penetrator weapon and a fragmentation weapon. The penetrator casing 34 remains intact as the warhead 12 strikes a hard target, such as a concrete building, allowing the warhead to penetrate into the hard target, perhaps to an interior space that may be occupied by targeted personnel. Then the fuze 38 detonates the explosive 36. This causes the casing 34, because of the weakness introduced by the reduced-thickness portions 62, to break up into fragments that can do damage within the hard target. In addition the preformed fragments 80 may enhance the fragmentation effect of the warhead 12.

The lethality-enhancement material 76 may alternatively or in addition include energetic materials, such as chemically-reactive materials. For example, the fragments 80 may be spaced apart, with energetic material placed between adjacent of the fragments within the holes 68. The energetic material may be or may include any of a variety of suitable explosives and/or incendiaries, for example hydrocarbon fuels, solid propellants, incendiary propellants, pyroforic metals (such as zirconium, aluminum, or titanium), explosives, oxidizers, or combinations thereof. Detonation of the explosive 36 may be used to trigger reaction (such as detonation) in the energetic material that is located at the reduced-thickness portions 62. This adds further energy to the detonation, and may aid in propelling the fragments 80 and/or in breaking up the penetrator casing 34 into fragments.

Many alternatives are possible for the arrangement and type of materials. The energetic materials may be placed between every adjacent pair of the fragments 80, or next to every second fragment, or every third fragment, etc. In addition, the materials may include substances that could neutralize or destroy chemical or biological agents.

The lethality-enhancement material 76 may be omitted from the holes 68, if desired, with holes 68 just filled with air (for example) or gases, or liquids. Without the lethality-enhancement material 76, the enhanced fragmentation of the warhead 12 comes from the breakup of the penetrator casing 34 into smaller fragments due to the reduced thickness areas of the penetrator casing 34.

The penetrator casing 34 may be made out of a suitable metal, such as a suitable steel (for example 4340 steel) or another hard material, such as titanium. Aluminum and composite materials are other possible alternatives. An example of a suitable material for the explosive 36 is PBXN-109, a polymer bonded explosive.

The holes 68 may be through holes, or may be blind holes that only go to a specific depth. The depth of blind holes may all be the same, or may vary according to achieve some desired effect, or due to system-level requirements such as varying hole length due to aircraft mounting lugs for example. The holes 68 may be made by machining, for example by drilling, or may be made by other suitable processes, such as acid etching. In the illustrated embodiment the holes 68 are only in the aft casing section 56, but as an alternative there may be holes or other reduced-thickness portions of parts of the nose 52.

Figure 4:
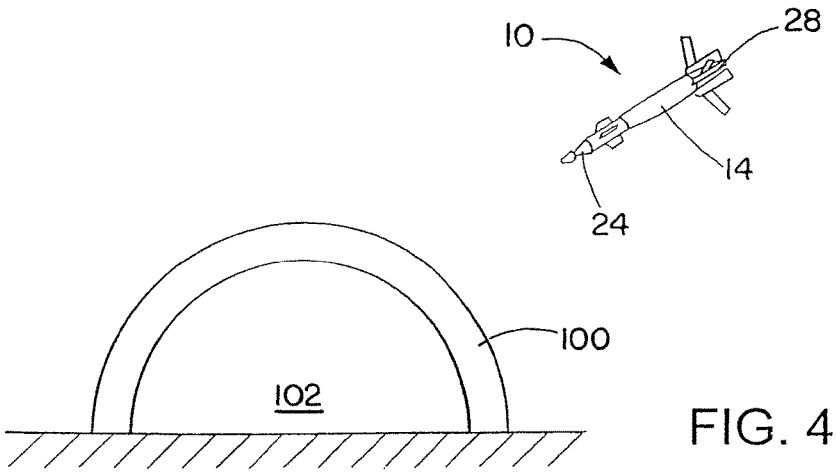
FIG. 4 is a side view illustrating a first step in the use of the munition of FIG. 1 as a hard target penetrator.
Figure 5:
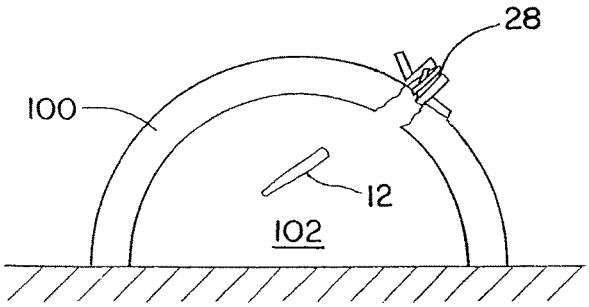
FIG. 5 is a side view illustrating a second step in the use of the munition as a hard target penetrator.
Figure 6:
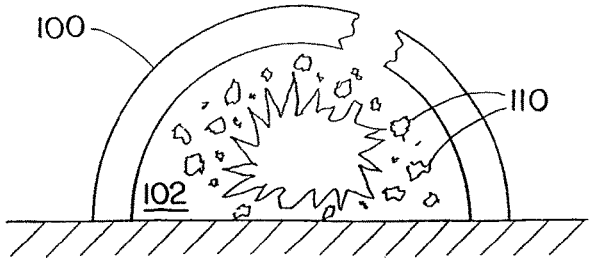
FIG. 6 is a side view illustrating a third step in the use of the munition as a harden target penetrator.

FIGS. 4-6 illustrate use of the munition 10 in a target penetration mode. In FIG. 4 the munition 10 is shown approaching a hard target 100. FIG. 5 shows the munition 10 impacting the hard target 100. Only the warhead 12, with its penetrator casing 34, is able to penetrate the hard target 100 to reach an inner area 102 of the hard target 100. The other parts of the munition, such as the airframe 14, the nose kit 24, and the tail kit 28, are destroyed and/or are separated from the warhead 12 by the collision with the hard target 100.

FIG. 6 illustrates the fragmentation effect of the warhead 12 after penetration. The illustration shows the situation after the explosive 36 has been detonated. Fragments 110 are spread within the hard target inner area 102 by the explosion. The fragments 110 include fragments produced by the destruction of the penetration casing 34, and perhaps other preformed fragments that were located in the holes 68 within the casing 34.

Figure 7:
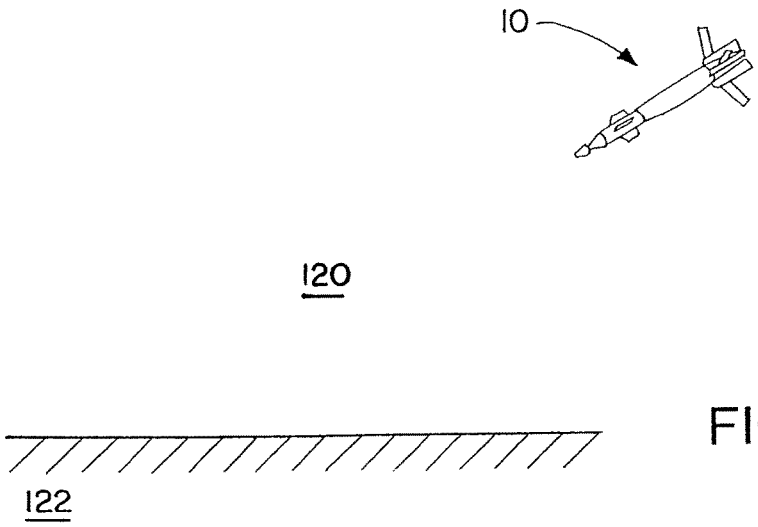
FIG. 7 is a side view illustrating a first step in the use of the munition of FIG. 1 in a fragmentation mode.
Figure 8:
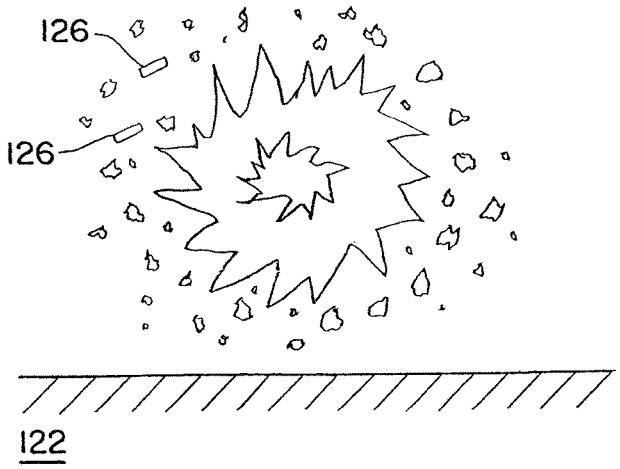
FIG. 8 is a side view illustrating a second step in the use of the munition in a fragmentation mode.

FIGS. 7 and 8 illustrate the use of the munition 10 as a fragmentation weapon, without penetration. FIG. 7 shows the munition 10 in a steep dive, approaching a desired detonation location 120 above the ground 122. The fuze 38 (FIG. 2B) may be set to provide detonation at a desired height, and different heights may be used for different types of engagement (different types of soft targets, and spreads over different areas). As an example, the desired detonation location 120 may be 3-4 meters above the ground 122, although a wide variety of other detonation heights are possible.

FIG. 8 illustrates the detonation at the location 120. The detonation spreads fragments 126 about the area near the detonation location 120. As with the detonation illustrated in FIG. 6, the fragments 126 may include both pieces of the penetrator casing 34 (FIG. 2B), and the preformed fragments 80 (FIG. 2B). The fragmentation mode shown in FIGS. 7 and 8 may be useful for attacking soft targets that spread out to some degree, such as enemy personnel out in the open. The use of the reduced-thickness portions 62 (FIG. 3) and the inclusion of the fragments 80 (FIG. 2B) in warhead 12 has been found to account for over 70% of the fragments that are sent forth by the munition 10.

The enhanced fragmentation provided by the munition 10 may allow more effective engagement of both soft and hard targets, as well flexibility in using a single munition in multiple modes, by use of the fuze 38 to control whether detonation occurs at a height above ground, or only after penetration of a hard target. The target selection (the mode of hard versus soft, the fuze delay, and/or the height of bust control setting) may be controlled in any of multiple ways: 1) preset by the ground crew before weapon launch for some systems; 2) controlled from the aircraft or other launcher before weapon launch by the pilot or ground control for some systems; and/or 3) controlled after weapon launch via a data link. The use of the reduced-thickness portions 62 (FIG. 3) and the inclusion of the fragments 80 (FIG. 2B) has been found to account for over 70% of the fragments that are sent forth by the munition 10.

In addition lower fragmentation velocity focuses the fragmentation effects forward of the warhead 12 for an improved lethal area footprint. The lower fragmentation velocity is due to a lower ratio of explosive mass to mass of the case. The ratio is lower because thicker case walls are required to penetrate hard targets. Also, a higher ratio of higher weight to cross sectional area is required to penetrate hard targets, thus the munition outer diameter is lower, and there is less volume for explosive than in a general purpose bomb. The lethal area footprint is improved because it does not spread fragments over a wide area. When the velocity vector of the munition and the velocity vector of the fragments flying outwards from the detonation are added, the fragments have a more downward trajectory (toward the target area) versus an outward trajectory, compared to a general purpose bomb. This results in having a higher fragment spatial density over the desired target area while not spraying a militarily ineffective quantity of fragments over a wide area, thus also limiting collateral damage.

The use of the reduced-thickness portions 62 and the inclusion of the fragments 80 may increase the number of fragments by 300-500%, and reduce fragment velocity by 30-50%. The lethal area of the munition 10 can also be controlled by controlling its selectable height of burst and terminal impact conditions. Terminal impact conditions may be controlled by a combination of the munition guidance/navigation software and selection of where the launching platform releases the munition.

Figure 9:
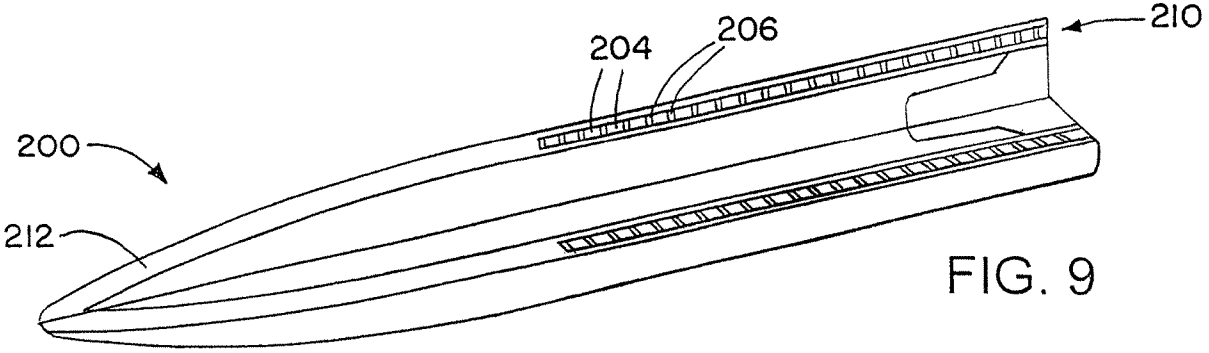
FIG. 9 is an oblique partial cutaway view showing details of a first alternate embodiment warhead.

FIG. 9 shows an alternative embodiment, a warhead 200 that has energetic material 204 and preformed fragments 206 in holes 210 in its penetration casing 212. In other respects the warhead 200 may be similar to the warhead 12 (FIG. 1), and may be used in a similar manner as part of a similar munition.

Figure 10:
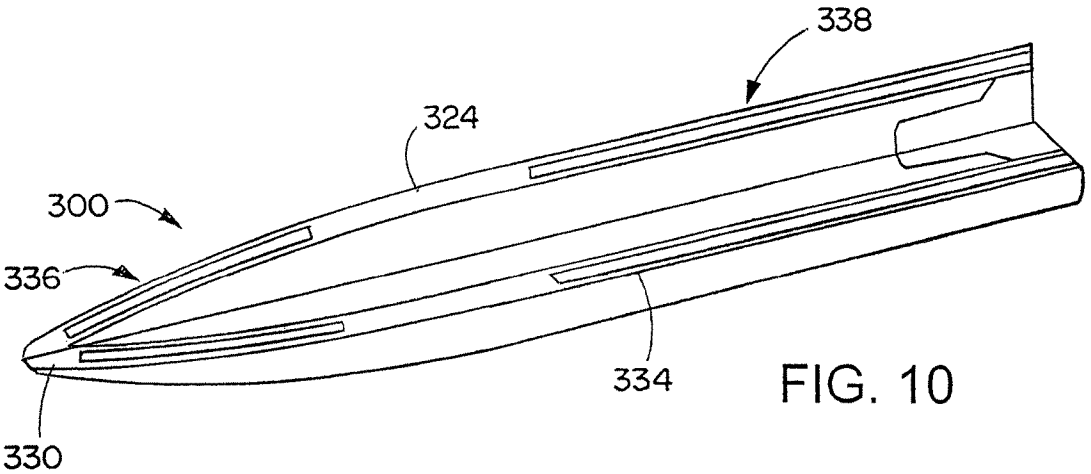
FIG. 10 is an oblique partial cutaway view showing details of a second alternate embodiment warhead.

FIG. 10 shows another alternative embodiment, a warhead 300 having a penetrator casing 324 with reduced-thickness portions in both its nose 330 and its aft section 334. One or both of the reduced-thickness nose portions 336 and the reduced-thickness aft section portions 338 may contain a lethality-enhancing material, such as preformed fragments or an energetic material. The portions 334 and 336 may contain similar or different lethality-enhancing materials, and may or may not be in communication with one another. In other respects the warhead 300 may be similar to other warheads disclosed herein.

Figure 11:
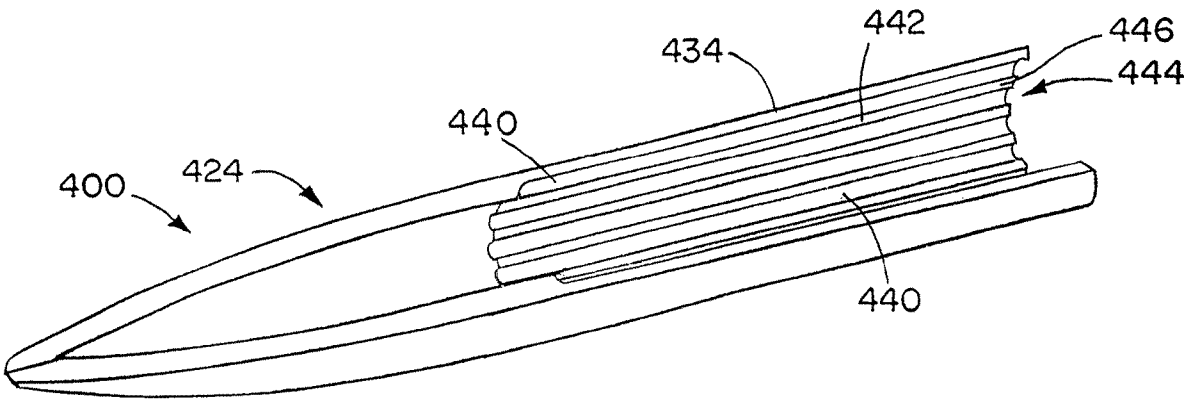
FIG. 11 is an oblique partial cutaway view showing details of a third alternate embodiment warhead.

FIG. 11 shows a warhead 400 which an aft section 434 of its penetrator casing 424 has a series of parallel grooves 440, in an axial direction, on an inner surface 442 of the aft section 434. The grooves 440 produce reduced-thickness portions 444 with adjacent portions 446 of normal (non-reduced) thickness. The grooves 440 may have a depth of 5 percent to 80 percent of the thickness of the adjacent parts of the aft section 434. Lethality-enhancing material, such as fragments or energetic material, may be placed in at least parts of the grooves 440.

Figure 12:
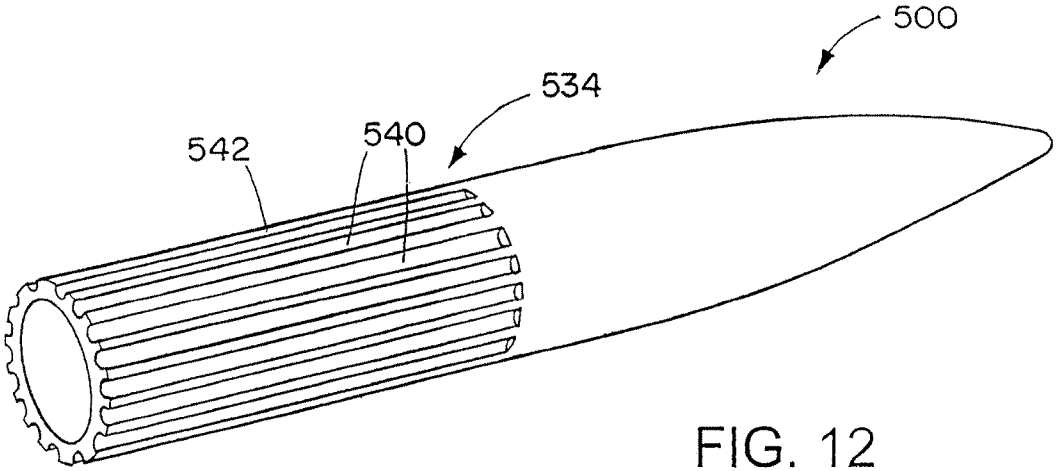
FIG. 12 is an oblique view showing details of a fourth alternate embodiment warhead.
Figure 13:
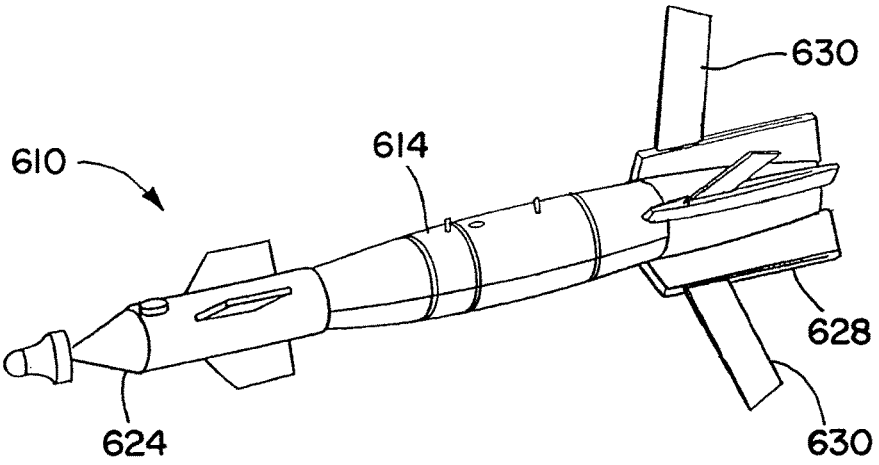
FIG. 13 is an oblique view of another embodiment munition.
Figure 14:
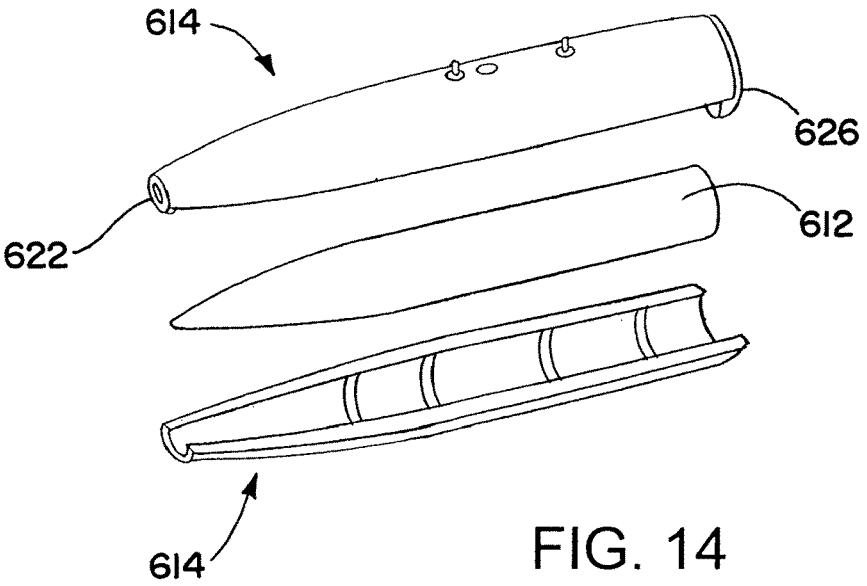
FIG. 14 is an exploded view of the airframe and warhead (penetrator) of the munition of FIG. 13.
Figure 15:
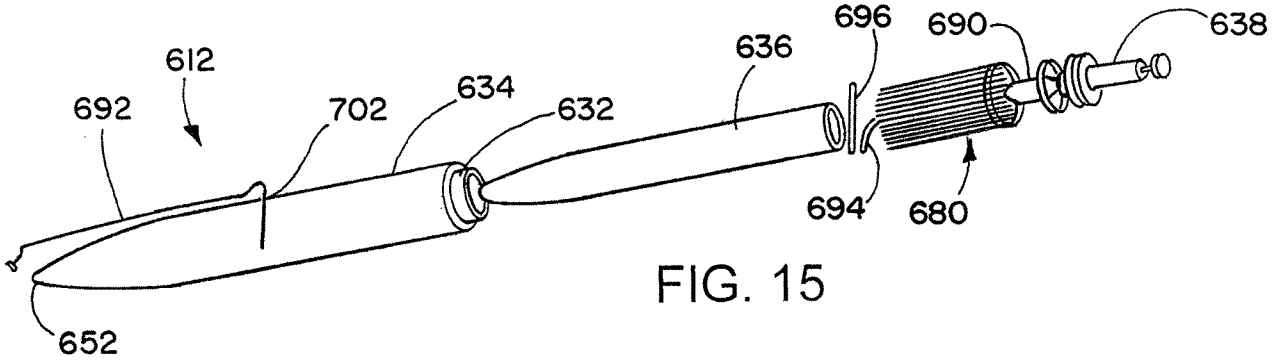
FIG. 15 is an exploded view of some components of the munition of FIG. 13.

FIG. 12 shows another variation, a warhead 500 that is similar to the warhead 400 (FIG. 11), except that it has grooves 540 that are on an outer surface 542 of an aft section 534. The grooves 440 and 540 may be combined in a single embodiment, and may be combinable with holes in the casing, such as the holes 68 (FIG. 3) of the warhead 12 (FIG. 1).

Other arrangements are possible for non-intersecting grooves and/or holes. For example, a single spiral groove may be placed on an outer or inner surface of a casing.

The warheads and munitions provide many advantages over prior warheads and munitions that are capable of penetrating hard targets. These advantages may include increased fragmentation, a lowered velocity of fragments, better focusing of fragments where desired, incorporation of other energetic materials for different effects and the ability for a penetrator weapon to be used in a separate non-penetrating fragmentation mode.

With reference now to FIGS. 13-16, a munition 610 is shown that has some additional features that may be combined with the features of the various embodiments described above. The munition 610 has a warhead or penetrator 612 that is located within a clamshell airframe 614. The airframe 614 has a forward connection 622 for receiving a nose kit 624, and an aft connection 626 for receiving a tail kit 628 with deployable fins 630. Focusing on aspects of the munition 610 that are not described in other embodiments discussed herein, the warhead 612 includes an asphaltic liner 632 between a penetrator casing 634 and an explosive 636. The asphaltic liner 632 serves as a sealing material and protective layer for the explosive 636 during storage, transportation and target penetration.

The penetrator casing 634 may be similar in configuration to casings in other embodiments, such as the casing 34 (FIG.

2B). The casing 634 has a series of holes in which preformed fragments 680 are placed, to enhance lethality of the munition 610.

A fuze 638 is used to detonate the explosive 636. The fuze 638 is located in a fuzewell 690 located at an aft end of the munition 612. The fuze 638 is operably coupled to the nose kit 624, for example to receive from the nose kit 624 a signal to detonate the fuze 638. The nose kit 624 may include a sensor or other device that it is used to provide a signal to trigger the firing of the fuze 638. The triggering event may be the munition 610 reaching a desired height for detonation (height of burst), for example.

The connection between the nose kit 624 and the fuze 638 includes an external electrical harness 692 and an internal electrical line or cord (or cable) 694 that runs through a conduit 696 that is inside the explosive 636. The conduit 96 is perpendicular to the central axis of the warhead 612, and spans the diameter of the casing 634. The harness 692 runs outside of the casing 34, between the casing 34 and the airframe 614. A forward end of the harness 692 is coupled to the nose kit 624 at the forward connection 622, near the nose 652 of the casing 634. An aft end of the harness 692 is connected to a coupling 702 in the middle of the casing 634. The aft end of the harness 692 enters the conduit 696 from the opposite side of the casing 634 from the coupling 702. The aft end of the harness 692 passes all the way through the warhead 610, to the coupling 702. From the coupling 702 the signal travels back to the fuze through the electrical line or cable 694. An umbilical cable (not shown) may also be connected to the fuze 638, to provide data, instructions, or other information to the munition 610 prior to launch.

Figure 16:
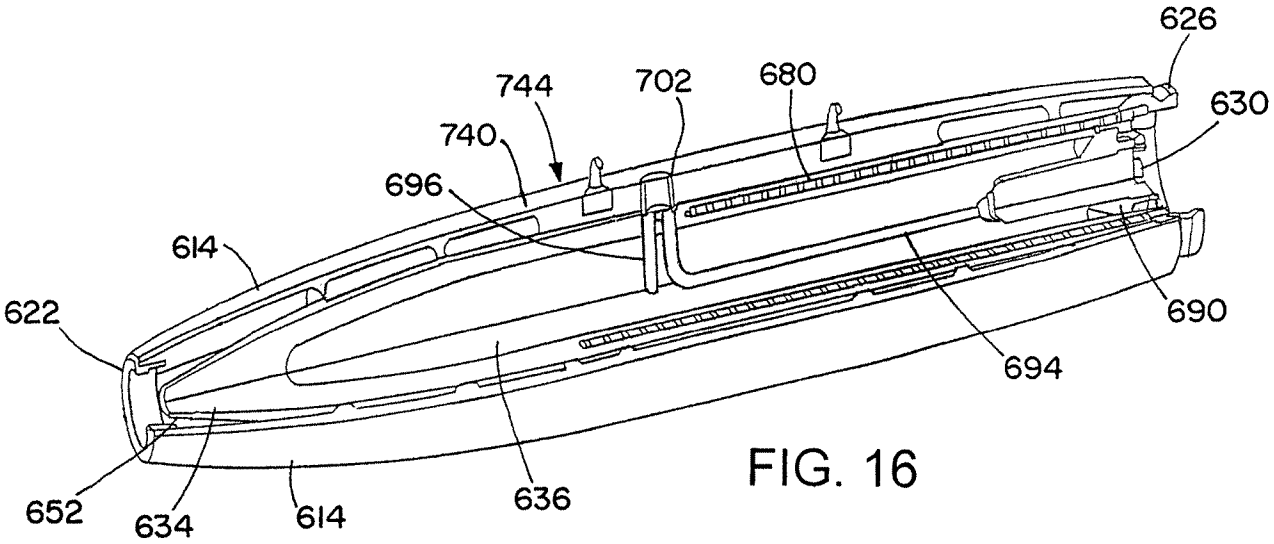
FIG. 16 is a partial sectional view of the warhead of the munition of FIG. 13.
Figure 17:
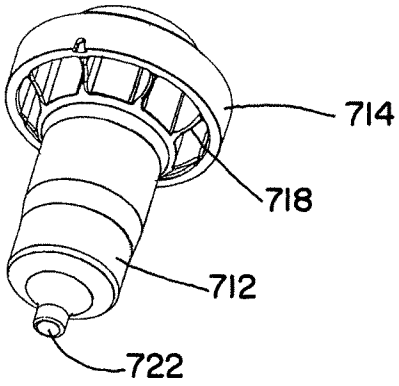
FIG. 17 is an oblique view of a fuzewell of the munition of FIG. 13.
Figure 18:
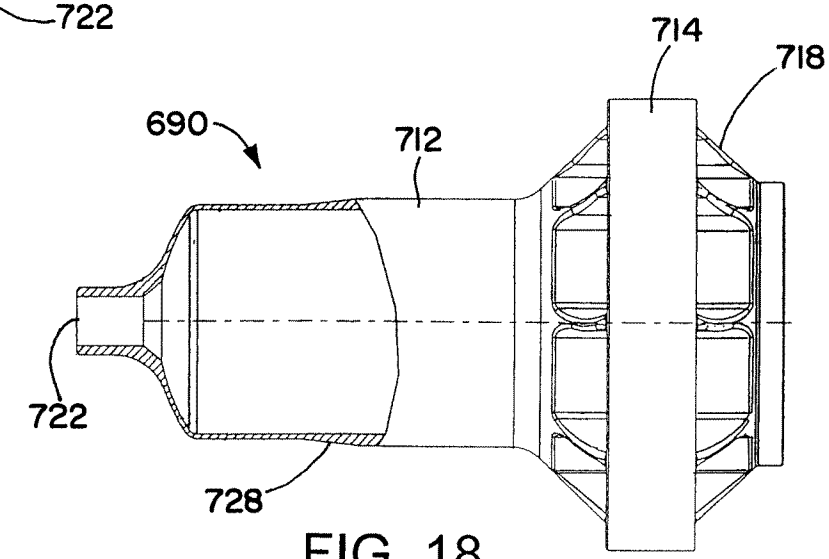
FIG. 18 is a side partial sectional view of the fuzewell of FIG. 17.
Figure 19:
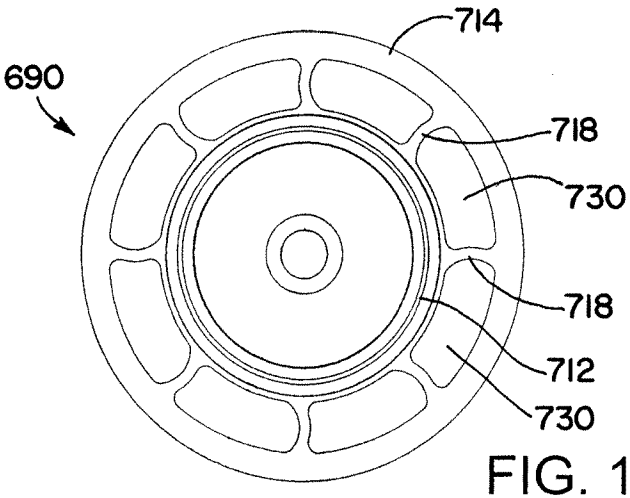
FIG. 19 is an end view of the fuzewell of FIG. 17.

With reference now in addition to FIGS. 17-19, the fuzewell 690 provides protection for the fuze 638 against shocks propagating through the warhead 612, for example as when the munition 610 impacts a hard target. It is desirable that the fuze 638 remain operable after such an impact, in order to allow detonation of the explosive 636 only after perforation of the hard target has been accomplished. Toward that end the fuzewell 690 has a configuration that allows it to resiliently absorb some energy, softening the effect of impacts such as during penetration of a hard target. The fuzewell 690 has a central housing 712 that contains the fuze 638, and a ring 714 around the central housing 712 that is connected to the housing 712 by a series of spokes 718. An opening 722 in the housing 712 enables connection of the electrical line 694 (FIG. 16) to the fuse 638.

The spokes 718 are curved in the circumferential direction with appropriate thicknesses, which facilitates flexing of the spokes in response to forces on the fuzewell 690 in a radial direction. The spokes 718 also may be configured to facilitate flexing in response to forces in an axial direction, for example by curvature and/or by variations in thickness. The reduction in cross-sectional area of the spokes 718, relative to that of the outer ring 714 and the central housing 712, facilitates flexing of the fuzewell 690 at the location of the spokes 718. Forces in an axial direction may occur due to a direct collision of the munition 610 with a hard structure, wherein the penetrator 612 impacts substantially perpendicular to the structure. Forces in a radial direction or a circumferential direction may occur due to a non-perpendicular impact, for example.

In addition, the spokes 718 have sloped surfaces in both axial directions, with the spokes 718 sloping from a narrow connection to the ring 714 to a broader connection to the housing 712. The spokes 718 may be connected to a thicker portion 728 of the housing 712, which may also have surfaces that are sloped in the axial direction.

The fuzewell 690 defines spaces 730 between the spokes 718. The spaces 730 allow for venting of gases from the explosive 636 (FIG. 16). This may enhance the safety of the munition 610, for instance by preventing a buildup of gas pressure within the warhead 612. Venting from the spaces 730 may improve performance of the munition 610 (or a part of the munition 610) in cook-off testing, for example.

The fuzewell 690 may be made of steel or another suitable material. The fuzewell 690 may be made as a single piece of material.

Lethality may be enhanced by providing fragmentation packs 740 in pockets or openings 744 in the airframe 614. The fragmentation packs 740 may be enclosed packages containing fragments and possibly other lethality enhancement materials, such as explosives. The fragments enclosed in the packs 740 may be similar in material and other aspects to the various fragments 80 (FIG. 2B) described above. Additional material in the fragmentation packs 740 may include any of the other lethality-enhancement materials 76 (FIG. 2B) described above, such as energetic material. The fragmentation pack casing for the fragmentation packs 740 may include any of a variety of suitable material, such as suitable metal and/or plastic materials. The fragmentation packs 740 may be deformable to aid in placement of the fragmentation packs 740 in the pockets 744. The fragmentation packs 740 may all be substantially identical, or there may be different sizes and/or shapes for the fragmentation packs 740 to be placed in different of the pockets 744.

As an alternative to (or in addition to) the fragmentation packs 740, fragments may be otherwise placed in the openings or pockets 744, in order to increase lethality. Fragments that are not prepackaged may be placed in the openings 744, for example with a potting material or covers to keep the fragments within the openings 744. The fragments placed in openings 744 may be similar to the fragments within the fragmentation packs 740, as described above. In addition, other lethality-enhancement material, such as that described above, may also be packed into the openings 744.

Figure 20:
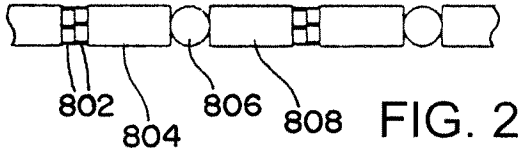
FIG. 20 is a side view of a first embodiment of a repeating pattern of lethality-enhancement material.
Figure 21:
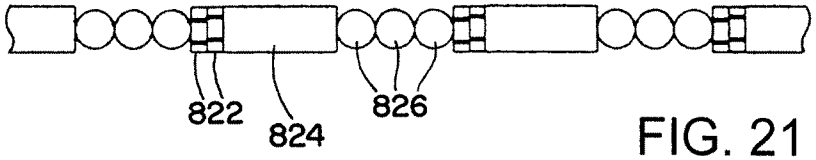
FIG. 21 is a side view of a second embodiment of a repeating pattern of lethality-enhancement material.
Figure 22:
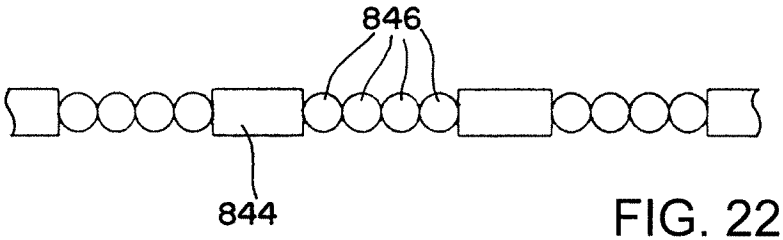
FIG. 22 is a side view of a third embodiment of a repeating pattern of lethality-enhancement material.

FIGS. 20-22 show examples of configurations for the lethality-enhancement material in holes in a penetrator, such as the holes 68 in the penetrator casing 34 (FIG. 2A). FIG. 20 shows a repeating pattern of a pair of star-shape fragments (described further below) 802, a cartridge 804 that contains fragments (also described further below, a tungsten ball 806, and another cartridge 808. The pattern may repeat as needed to fill the entire length of the hole in question.

FIG. 21 shows a different repeating pattern, with a pair of star-shape fragments 822, a cartridge 824, and three tungsten balls 826. FIG. 22 shows another repeating pattern, with a cartridge 844 alternating with groups of four tungsten balls 846.

The patterns shown in FIGS. 20-22 are only examples, and many variations on them are possible. Other materials and/or configurations may be used. The same pattern may be used in all of the holes, or different patterns may be used in different holes. Alternatively or in addition, the holes may be filled without use of repeating patterns.

Figure 23:
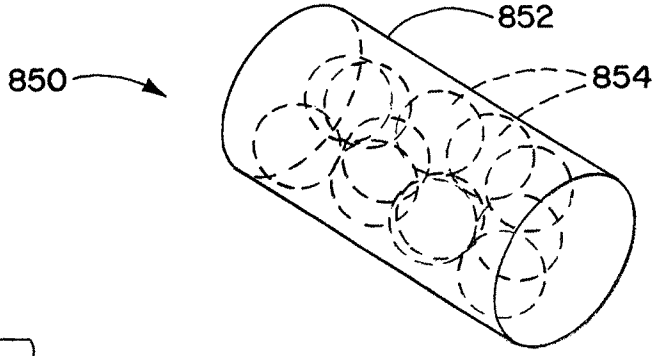
FIG. 23 is an oblique view of a cartridge that may be used as part of the patterns of FIGS. 20-22.

FIG. 23 shows a cartridge 850, an example of the cartridges in the arrangements in FIGS. 20-22. The cartridge 850 includes a casing 852, and a series of small fragments 854 (spheres in the illustrated embodiment) within the casing 852. The small fragments 854 may have many alternative shapes, such as cubes and/or thin cylinders and/or other shapes. Other materials, such as pyrophoric materials contained within cylindrical cartridges. The casing 852 may have various lengths and/or diameters.

Figure 24:
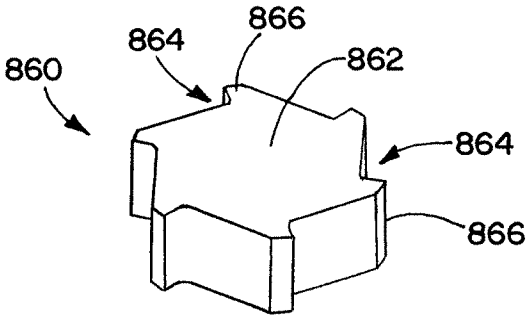
FIG. 24 is an oblique view of a star-shape fragment that may be used as part of the patterns of FIGS. 20 and 21.

FIG. 24 shows an example of a star-shape fragment 860. The star-shape fragment 860 have a flat body 862 with a series of flutes 864 that produce edged protrusions 866. When ejected from a munition, such as the munition 810, the star-shape fragments 860 may spin during flight, allowing stable flight over a considerable distance. The edged protrusions 866 may facilitate the star-shape fragments 860 penetrating objects that they strike. The protrusions 866 may also aid in rupturing or otherwise opening up cartridge casings, such as the casing 852 (FIG. 23) of the cartridge 850 (FIG. 23), to release the fragments 854 (FIG. 23) within the casing 852. The protrusions 866 may have any of a variety of suitable shapes, for example having barbed shapes that facilitate penetration and destruction of objects that the star-shape fragments 860 strike. In the illustrated embodiment the fragment 860 has six of the protrusion 866, but flat-bodied fragments with other numbers of protrusions are possible as alternatives. The star-shape fragment 860 may be made of similar materials to those of the other fragments described herein.

Figure 25:
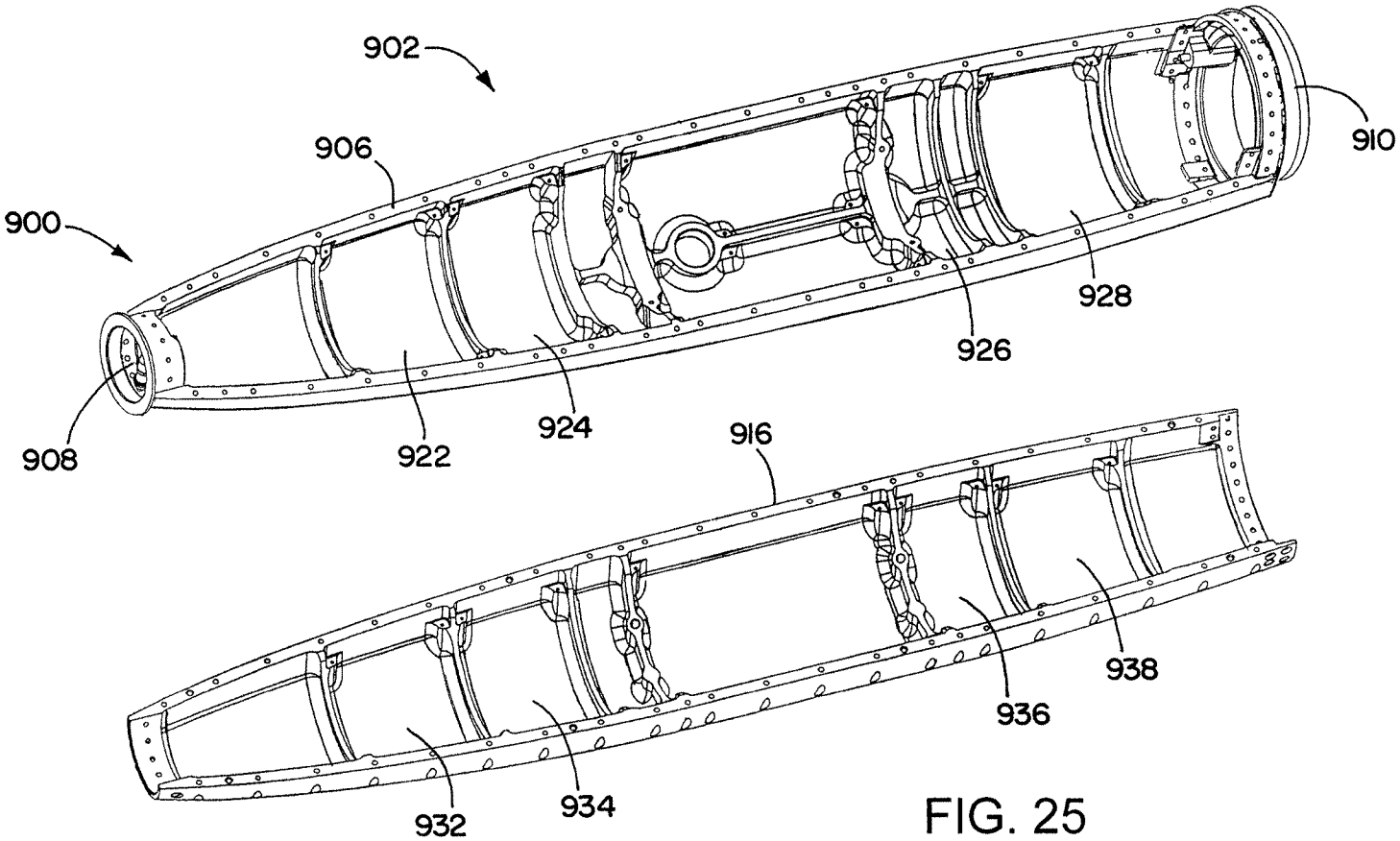
FIG. 25 is an oblique view of parts of a clamshell enclosure that is part of a munition, according to an embodiment.

FIG. 25 shows parts of a clamshell enclosure 900 that may be used to enclose any of the warheads described above. The enclosure 900 includes an upper assembly 902, which includes an upper clamshell piece 906, as well as a nose ring 908 and a tail ring 910. A lower clamshell piece 916 engages the parts of the upper assembly 902 to enclose the warhead. The pieces 906 and 916 may be made of aluminum alloy, or another suitable material. The pieces 906 and 916 together define a series of bays (openings or cavities) for receiving fragments and/or other lethality enhancement materials, in any of a variety of forms. The upper clamshell piece 906 has upper bay portions 922, 924, 926, and 928, and the lower clamshell piece 916 has lower bay portions 932, 934, 936, and 938, from front to back in both pieces.

Figure 26:
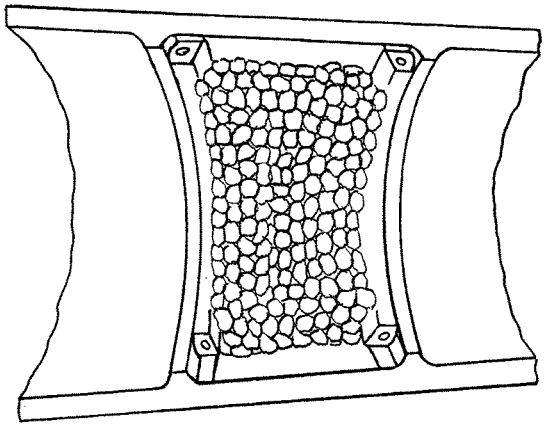
FIG. 26 illustrates a first step in placing material in a bay portion of one of the clamshell pieces of FIG. 25.
Figure 27:
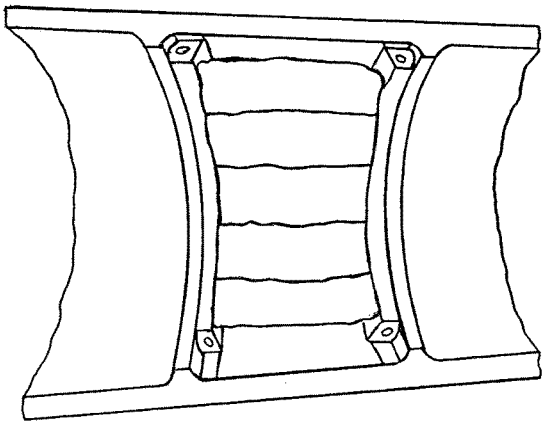
FIG. 27 illustrates a second step in placing material in a bay portion of one of the clamshell pieces of FIG. 25.
Figure 28:
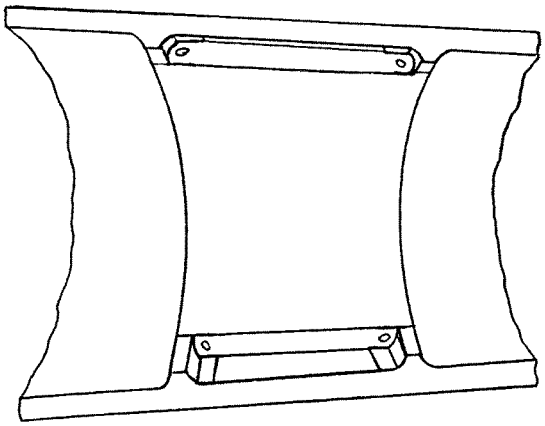
FIG. 28 illustrates a third step in placing material in a bay portion of one of the clamshell pieces of FIG. 25.

FIGS. 26-28 illustrate a process of filling one of the bay portions 922-938. In FIG. 26 fragments are bonded to the inside surface of one of the clamshell pieces at one of the bay portions. The fragments may be spherical fragments, such as reactive material coated metal alloy balls, and may be bonded to the clamshell piece using polysulfide or a polysulfide compound.

In FIG. 27 bags or packs of materials are placed on top of the layer of fragments shown in FIG. 26. The packs shown in FIG. 27 are examples of the fragmentation packs 740 (FIG. 16) described earlier. The packs in FIG. 27 are plastic bags that enclose lethality enhancement material. The packs may include bags containing metallic powder materials, such as aluminum, magnesium, zirconium, titanium or other reactive materials, for example providing incendiary or enhanced blast effects by being compacted in a suitable binder material. The bags may also include one or more bags containing solid fragments, such as spherical fragments, for example made of reactive material coated steel or tungsten alloy balls, or another suitable solid material.

In FIG. 28 the bay is sealed to keep the fragments and the packs (bags) in place. The bay may be sealed by a solid material, such as a sheet of aluminum. The solid-material shell may be bonded to the clamshell piece and/or the packs with polysulfide (or another suitable adhesive), and then mechanically fastened to keep it in place, such as with a series of screws or bolts.

The configuration and method shown in FIGS. 26-28 is only one example of possible configurations. Many alternative configurations and materials are possible, some of which are described elsewhere herein.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A warhead comprising:

a penetrator casing; and an explosive within the penetrator casing;

wherein the casing has a series of non-intersecting elongate reduced-thickness portions, thinner than portions of the casing that are adjacent the reduced-thickness portions;

wherein the penetrator casing has a monolithic nose without cutouts or openings therethrough, covering a front of the warhead, and an aft section extending back from the nose;

wherein the reduced-thickness portions are parts of the aft section;

wherein the nose has a thickest portion that is at least twice the thickness of the portions of the casing that are adjacent the reduced-thickness portions;

wherein the elongate reduced-thickness portions are portions in which the casing has holes therein, whereby the holes produce the reduced-thickness portions;

wherein the holes each have a length of more than half the aft section, with the length more than ten times a width of the holes; and wherein the nose and the aft section are parts of a single continuous uninterrupted piece.

2. The warhead of claim 1, wherein the aft section is substantially cylindrical.

3. The warhead of claim 1, wherein the elongate reduced-thickness portions are parallel to one another.

4. The warhead of claim 1, wherein the elongate reduced-thickness portions extend in straight lines.

5. The warhead of claim 1, wherein the elongate reduced-thickness portions extend substantially parallel to a longitudinal axis of the warhead.

6. The warhead of claim 1, wherein the holes include a series of longitudinal holes therein, separated circumferentially around the penetrator casing.

7. The warhead of claim 6, wherein the holes have lengths in a longitudinal direction that are at least ten times their widths in a circumferential direction.

8. The warhead of claim 1, further comprising a lethality-enhancement material located at the reduced-thickness portions of the penetrator casing.

9. The warhead of claim 8, wherein the lethality-enhancement material includes solid fragments that are projected by the warhead when the explosive is detonated, with each of the holes containing multiple of the fragments.

10. The warhead of claim 9, wherein the solid fragments include spherical fragments.

11. The warhead of claim 9, wherein the solid fragments include fragments in casings.

12. The warhead of claim 9, wherein the solid fragments include fragments having flat bodies.

13. The warhead of claim 12, wherein fragments having flat bodies are star-shape fragment having a series of edged protrusions extending from each of the flat bodies.

14. The warhead of claim 9, wherein the wherein the solid fragments are part of a repeating pattern of different fragments, having different materials, different shapes, and/or different sizes.

15. The warhead of claim 8, wherein the lethality-enhancement material includes an energetic material that releases energy when the explosive is detonated.

16. The warhead of claim 1, wherein the holes each have a diameter of 0.31 to 1.9 cm.

17. The warhead of claim 16, wherein the aft section has a thickness of 1.9 to 5.1 cm.

* * * * *